US007210248B2

(12) United States Patent
Van Noy et al.

(10) Patent No.: US 7,210,248 B2
(45) Date of Patent: May 1, 2007

(54) SHOE VENTILATION SYSTEM

(75) Inventors: Allen W. Van Noy, Weisendorf (DE); Gerd Rainer Manz, Weisendorf (DE)

(73) Assignee: adidas International Marketing B.V., Amsterdam (NL)

( * ) Notice: Subject to any disclaimer, the term of this patent is extended or adjusted under 35 U.S.C. 154(b) by 245 days.

(21) Appl. No.: 10/712,790

(22) Filed: Nov. 13, 2003

(65) Prior Publication Data

US 2004/0111918 A1 Jun. 17, 2004

(30) Foreign Application Priority Data

Nov. 26, 2002 (DE) ..... 102 55 094

(51) Int. Cl.
*A43B 7/06* (2006.01)

(52) U.S. Cl. ..... 36/3 R; 36/3 B; 36/3 A

(58) Field of Classification Search ..... 36/3 B, 36/3 R, 3 A

See application file for complete search history.

(56) References Cited

U.S. PATENT DOCUMENTS

| | | | | |
|---|---|---|---|---|
| 30,391 | A | 10/1860 | Dexter | |
| 41,879 | A | 3/1864 | Webb | |
| 60,987 | A | 1/1867 | Ayer | |
| 363,377 | A | 5/1887 | Faye, Jr. | |
| 387,335 | A | 8/1888 | Barker | |
| 556,825 | A | 3/1896 | King | |
| 570,814 | A | 11/1896 | Owen | |
| 592,822 | A | 11/1897 | Parker | |
| 896,488 | A | 8/1908 | Valiant | |
| 905,617 | A | 12/1908 | Wood | |
| 1,106,986 | A | 8/1914 | Stucki | |
| 1,138,557 | A | 5/1915 | Gustaveson | |
| 1,535,207 | A | 4/1925 | Dorff | |
| 1,616,254 | A | 2/1927 | Suárez | |
| 1,717,183 | A * | 6/1929 | Brenner | 36/3 A |
| 1,756,083 | A * | 4/1930 | Brenner | 36/3 A |
| 1,797,309 | A | 3/1931 | Wojciechowski | |
| 1,828,320 | A | 10/1931 | Daniels | |
| 1,974,456 | A * | 9/1934 | Goldzweig | 36/3 R |
| 1,994,681 | A | 3/1935 | Blumenfeld | |
| 2,082,309 | A * | 6/1937 | Turiansky | 36/3 A |

(Continued)

FOREIGN PATENT DOCUMENTS

| | | |
|---|---|---|
| BE | 1011574 | 11/1999 |

(Continued)

OTHER PUBLICATIONS

Asics, "Sport Schuhe & Taschen, Fruhjahr/Sommer 1999" brochure, and English translation. (4 pgs.).

(Continued)

*Primary Examiner*—Ted Kavanaugh
(74) *Attorney, Agent, or Firm*—Goodwin Procter LLP

(57) ABSTRACT

Disclosed is a ventilation system for articles of footwear. The ventilation system includes at least one opening in the shoe upper and at least one guiding surface over the opening. The guiding surface is oriented such that airflow is directed into the opening as the shoe moves. For even greater ventilation, the ventilation system may include a plurality of openings and guiding surfaces. Additionally, a discharge outlet may be included in the sole of the shoe.

35 Claims, 5 Drawing Sheets

U.S. PATENT DOCUMENTS

| | | | | | |
|---|---|---|---|---|---|
| RE21,392 | E | * | 3/1940 | Hurwit | 36/3 A |
| 2,205,963 | A | * | 6/1940 | Stritter | 36/3 A |
| 2,334,719 | A | | 11/1943 | Margolin | |
| 2,347,207 | A | | 4/1944 | Margolin | |
| 2,356,490 | A | | 8/1944 | Crotty | |
| 2,358,342 | A | | 9/1944 | Margolin | |
| 2,408,792 | A | | 10/1946 | Margolin | |
| 2,432,533 | A | | 12/1947 | Margolin | |
| 2,434,024 | A | | 1/1948 | Vlasak | |
| 2,457,944 | A | | 1/1949 | Vlastos | |
| 2,474,815 | A | | 7/1949 | Brahm | |
| 2,614,339 | A | * | 10/1952 | Herceg | 36/3 A |
| 2,722,063 | A | | 11/1955 | Drefvelin | |
| 2,725,645 | A | | 12/1955 | Scala | |
| 2,751,692 | A | | 6/1956 | Cortina | |
| 2,884,716 | A | | 5/1959 | Shelare et al. | |
| 3,048,931 | A | | 8/1962 | Farinello | |
| 3,061,950 | A | | 11/1962 | Levine | |
| 3,086,301 | A | | 4/1963 | Pastor | |
| 3,273,264 | A | | 9/1966 | Farinello, Jr. | |
| 3,273,265 | A | | 9/1966 | Reinert et al. | |
| 3,383,782 | A | | 5/1968 | McGinnity | |
| 3,426,455 | A | | 2/1969 | Drago | |
| 3,555,709 | A | | 1/1971 | Raffaelli | |
| 3,574,958 | A | | 4/1971 | Martuch | |
| 3,863,272 | A | | 2/1975 | Guille | |
| 4,005,531 | A | | 2/1977 | Weintraub et al. | |
| 4,100,685 | A | | 7/1978 | Dassler | |
| 4,134,955 | A | | 1/1979 | Hanrahan, Jr. et al. | |
| 4,151,660 | A | | 5/1979 | Yoshimi et al. | |
| 4,222,183 | A | | 9/1980 | Haddox | |
| 4,290,211 | A | | 9/1981 | Csengeri | |
| 4,297,796 | A | | 11/1981 | Stirtz et al. | |
| 4,438,573 | A | | 3/1984 | McBarron | |
| 4,485,568 | A | | 12/1984 | Landi et al. | |
| 4,507,880 | A | | 4/1985 | Ohashi | |
| 4,619,055 | A | | 10/1986 | Davidson | |
| 4,635,385 | A | | 1/1987 | Ogden | |
| 4,654,982 | A | | 4/1987 | Lee | |
| 4,679,335 | A | | 7/1987 | Berlese | |
| 4,693,021 | A | | 9/1987 | Mazzarolo | |
| 4,739,765 | A | | 4/1988 | Sydor et al. | |
| 4,754,559 | A | | 7/1988 | Cohen | |
| 4,776,110 | A | | 10/1988 | Shiang | |
| 4,782,602 | A | | 11/1988 | Lakic | |
| 4,813,160 | A | | 3/1989 | Kuznetz | |
| 4,831,749 | A | | 5/1989 | Tsai | |
| 4,835,883 | A | | 6/1989 | Tetrault et al. | |
| 4,837,948 | A | | 6/1989 | Cho | |
| 4,864,738 | A | | 9/1989 | Horovitz | |
| 4,893,418 | A | | 1/1990 | Ogden | |
| 4,894,932 | A | | 1/1990 | Harada et al. | |
| 4,896,440 | A | | 1/1990 | Salaverria | |
| 4,899,465 | A | | 2/1990 | Bleimhofer et al. | |
| 4,899,467 | A | | 2/1990 | Mackey | |
| 4,910,887 | A | | 3/1990 | Turner et al. | |
| 4,939,851 | A | | 7/1990 | Miller | |
| 4,993,173 | A | | 2/1991 | Gardiner | |
| 5,035,068 | A | | 7/1991 | Biasi | |
| 5,044,096 | A | | 9/1991 | Polegato | |
| 5,070,629 | A | | 12/1991 | Graham et al. | |
| 5,086,572 | A | | 2/1992 | Lee | |
| 5,235,761 | A | | 8/1993 | Chang | |
| 5,295,312 | A | | 3/1994 | Blumberg et al. | |
| 5,295,313 | A | | 3/1994 | Lee | |
| 5,317,819 | A | | 6/1994 | Ellis, III | |
| 5,319,866 | A | | 6/1994 | Foley et al. | |
| 5,339,544 | A | | 8/1994 | Caberlotto | |
| 5,341,581 | A | | 8/1994 | Huang | |
| 5,342,070 | A | | 8/1994 | Miller et al. | |
| 5,357,689 | A | | 10/1994 | Awai | |
| 5,367,788 | A | | 11/1994 | Chen | |
| 5,367,791 | A | | 11/1994 | Gross et al. | |
| 5,375,345 | A | | 12/1994 | Djuric | |
| 5,390,430 | A | | 2/1995 | Fitchmun et al. | |
| 5,400,526 | A | | 3/1995 | Sessa | |
| 5,401,039 | A | | 3/1995 | Wolf | |
| 5,465,508 | A | | 11/1995 | Bourdeau | |
| 5,499,459 | A | | 3/1996 | Tomaro | |
| 5,505,011 | A | | 4/1996 | Bleimhofer | |
| 5,551,172 | A | | 9/1996 | Yu | |
| 5,584,130 | A | | 12/1996 | Perron | |
| 5,588,226 | A | | 12/1996 | Schenkel | |
| 5,598,644 | A | | 2/1997 | Polegato | |
| 5,607,745 | A | | 3/1997 | Ogden | |
| 5,611,152 | A | | 3/1997 | Richard et al. | |
| 5,619,809 | A | | 4/1997 | Sessa | |
| 5,655,314 | A | | 8/1997 | Petracci | |
| 5,664,343 | A | | 9/1997 | Byrne | |
| 5,675,914 | A | | 10/1997 | Cintron | |
| 5,685,091 | A | | 11/1997 | Yalamanchili | |
| 5,697,171 | A | | 12/1997 | Phillips | |
| 5,699,627 | A | | 12/1997 | Castro | |
| 5,714,229 | A | | 2/1998 | Ogden | |
| 5,738,937 | A | | 4/1998 | Baychar | |
| 5,797,610 | A | | 8/1998 | Grande et al. | |
| 5,809,665 | A | | 9/1998 | Suenaga | |
| 5,815,949 | A | | 10/1998 | Sessa | |
| 5,826,349 | A | | 10/1998 | Goss | |
| 5,845,418 | A | | 12/1998 | Chi | |
| 5,852,884 | A | | 12/1998 | Miotto | |
| 5,918,381 | A | | 7/1999 | Landry | |
| 5,946,824 | A | | 9/1999 | Tighe et al. | |
| 5,955,172 | A | | 9/1999 | Hurten | |
| 5,979,076 | A | | 11/1999 | Li | |
| 5,983,524 | A | | 11/1999 | Polegato | |
| 5,983,525 | A | | 11/1999 | Brown | |
| 5,992,052 | A | | 11/1999 | Moretti | |
| 5,996,250 | A | | 12/1999 | Reed et al. | |
| 6,006,447 | A | | 12/1999 | Neal et al. | |
| 6,012,236 | A | | 1/2000 | Pozzobon | |
| 6,032,388 | A | | 3/2000 | Fram | |
| 6,041,518 | A | | 3/2000 | Polycarpe | |
| 6,041,519 | A | | 3/2000 | Cheng | |
| 6,044,577 | A | | 4/2000 | Clark | |
| 6,085,444 | A | | 7/2000 | Cho | |
| 6,196,556 | B1 | | 3/2001 | Bonaventure et al. | |
| 6,239,501 | B1 | | 5/2001 | Komarechka | |
| 6,255,799 | B1 | | 7/2001 | Le et al. | |
| 6,389,711 | B1 | | 5/2002 | Polegato | |
| 6,401,364 | B1 | | 6/2002 | Burt | |
| 6,408,541 | B1 | | 6/2002 | Moretti | |
| 6,416,610 | B1 | | 7/2002 | Matis et al. | |
| 6,421,933 | B1 | | 7/2002 | Zamprogno | |
| 6,442,760 | B2 | | 9/2002 | Moretti | |
| 6,446,359 | B2 | | 9/2002 | Tomat | |
| 6,446,360 | B1 | | 9/2002 | Sheets et al. | |
| 6,487,891 | B2 | | 12/2002 | Moretti | |
| 6,508,015 | B1 | | 1/2003 | Rauch | |
| 6,562,271 | B2 | | 5/2003 | Hiraoka et al. | |
| 6,564,475 | B2 | * | 5/2003 | Collins et al. | 36/3 R |
| 6,594,917 | B2 | | 7/2003 | Ricco' et al. | |
| 6,594,918 | B2 | | 7/2003 | Hatfield et al. | |
| 6,604,302 | B2 | | 8/2003 | Moretti | |
| 6,655,048 | B2 | | 12/2003 | Moretti | |
| 6,662,469 | B2 | | 12/2003 | Belley et al. | |
| 6,681,500 | B2 | | 1/2004 | Moretti | |
| 6,725,571 | B2 | | 4/2004 | Liu | |
| 6,823,609 | B2 | | 11/2004 | Moretti | |
| 6,865,825 | B2 | | 3/2005 | Bailey, Sr. et al. | |
| 6,871,420 | B2 | * | 3/2005 | Shikhashvili | 36/8.1 |
| 6,874,251 | B2 | | 4/2005 | Moretti | |
| 6,904,705 | B2 | | 6/2005 | Moretti | |
| 6,918,695 | B2 | | 7/2005 | Moretti et al. | |

| | | | | |
|---|---|---|---|---|
| 2001/0011426 | A1 | 8/2001 | Tomat | |
| 2002/0011009 | A1 | 1/2002 | Pan | |
| 2002/0012784 | A1 | 1/2002 | Norton et al. | |
| 2002/0017036 | A1* | 2/2002 | Berger et al. | 36/3 B |
| 2002/0040537 | A1 | 4/2002 | Moretti | |
| 2002/0050074 | A1 | 5/2002 | Ricco et al. | |
| 2002/0078593 | A1 | 6/2002 | Pavelescu et al. | |
| 2002/0100187 | A1 | 8/2002 | Polegato | |
| 2002/0166262 | A1 | 11/2002 | Hernandez | |
| 2002/0184927 | A1 | 12/2002 | Moretti | |
| 2003/0136024 | A1 | 7/2003 | Su | |
| 2004/0013883 | A1 | 1/2004 | Moretti | |
| 2004/0035022 | A1 | 2/2004 | Moretti | |
| 2004/0045189 | A1 | 3/2004 | Moretti | |
| 2004/0049942 | A1* | 3/2004 | Chen | 36/3 A |
| 2005/0000117 | A1 | 1/2005 | Moretti | |
| 2005/0016032 | A1 | 1/2005 | Cox et al. | |
| 2005/0060906 | A1 | 3/2005 | Zimefeld | |
| 2005/0102856 | A1 | 5/2005 | Jones et al. | |
| 2005/0241082 | A1 | 11/2005 | Moretti | |
| 2005/0252035 | A1 | 11/2005 | Moretti | |

FOREIGN PATENT DOCUMENTS

| | | | |
|---|---|---|---|
| CA | 2047044 | | 3/1997 |
| CH | 198691 | | 7/1938 |
| CH | 418 179 | | 7/1966 |
| DE | 20808 | | 4/1882 |
| DE | 121957 | | 10/1900 |
| DE | 203734 | | 4/1908 |
| DE | 600 894 | | 8/1934 |
| DE | 800 364 | | 11/1950 |
| DE | 32 25 451 | | 2/1983 |
| DE | G 92 08 875.9 | | 10/1992 |
| DE | 41 28 704 | A1 | 3/1993 |
| DE | 199 37 334 | A1 | 10/2001 |
| EP | 0 121 645 | | 10/1984 |
| EP | 0 427 556 | A2 | 5/1991 |
| EP | 0 465 222 | | 1/1992 |
| EP | 0 479 183 | | 4/1992 |
| EP | 0350 611 | B1 | 5/1995 |
| EP | 0 732 067 | A1 | 9/1996 |
| EP | 0857 433 | A2 | 8/1998 |
| EP | 0 910 964 | A2 | 4/1999 |
| EP | 0927 524 | A1 | 7/1999 |
| EP | 0956 789 | | 11/1999 |
| EP | 0960 579 | | 12/1999 |
| EP | 1 118 280 | A2 | 7/2001 |
| EP | 1 245 166 | | 10/2002 |
| EP | 1 312 275 | | 5/2003 |
| EP | 1 118 280 | B1 | 4/2004 |
| FR | 1 142 786 | | 9/1957 |
| FR | 1 492 484 | | 9/1966 |
| FR | 2 744 926 | | 8/1997 |
| GB | 395 221 | | 7/1933 |
| GB | 2 183 140 | | 6/1987 |
| GB | 2 247 391 | | 3/1992 |
| GB | 2 315 010 | | 1/1998 |
| IT | 352511 | | 9/1937 |
| JP | H02-57403 | | 4/1990 |
| JP | H02-11802 | | 2/1991 |
| JP | 03-236801 | | 10/1991 |
| JP | 06-141906 | | 5/1994 |
| JP | 07-327706 | | 12/1995 |
| JP | 08-056704 | | 3/1996 |
| JP | 08-112104 | | 5/1996 |
| JP | 10-014605 | | 1/1998 |
| JP | 10-362414 | | 6/2000 |
| WO | 94/06317 | | 3/1994 |
| WO | 97/28711 | | 8/1997 |
| WO | 99/66812 | | 12/1999 |
| WO | WO 05/011417 | | 2/2005 |
| WO | WO 05/063069 | | 7/2005 |
| WO | WO 05/063070 | | 7/2005 |
| WO | WO 05/070658 | | 8/2005 |

OTHER PUBLICATIONS

Asics, "Sportschuhe & Taschen, Herbst/Winter 1999" brochure, and English translation. (6 pgs.).

New Balance, "Fall 1998, Performance Footwear" brochure. (2 pgs.).

Lotto, "Schuhe/Textilien Saison '98/'99" brochure, and English translation. (6 pgs.).

Reebok, "Schuhe 3. Quartel 1998" brochure, and English translation. (6 pgs.).

European Search Report for EP03026926 dated Feb. 10, 2004, 2 pgs.

* cited by examiner

SHOE VENTILATION SYSTEM

CROSS-REFERENCE TO RELATED APPLICATION

This application incorporates by reference, and claims priority to and the benefit of, German patent application serial number 10255094.8, which was filed on Nov. 26, 2002.

TECHNICAL FIELD

The invention relates generally to articles of footwear. In particular, the invention relates to a ventilation system for a shoe that allows for improved ventilation and vapor exchange.

BACKGROUND INFORMATION

The technical development of shoes, in particular sports shoes, has advanced in recent years. Presently, sophisticated cushioning systems are available, which accommodate varying requirements during a gait cycle and which selectively support the biomechanical processes occurring during walking or running. Use of plastic materials in the manufacture of sports shoes is directly responsible for these improvements in cushioning and support.

Incorporation of plastics into footwear, however, has reduced the permeability for air and moisture that was available with more natural footwear materials, such as leather and fabric. It is well-known that the foot has a particularly high density of perspiration pores, which release great amounts of moisture, especially during sports activities. This excessive moisture should be quickly removed from the surface of the foot in order to avoid a humid foot climate, a condition that at a minimum causes discomfort and odor, but at worst, may lead to foot diseases. Thus, it is desirable that there be sufficient ventilation of the interior of the shoe and, thereby of the foot. For this reason, different approaches to ventilate and remove sweat from the foot area exist in the art.

For example, one Applicant of the present invention has also disclosed, in German Patent No. DE 100 36 100, the disclosure of which is hereby incorporated herein by reference in its entirety, a multilayer sole construction having overlapping openings in different sole layers in order to ventilate the interior of the shoe from below. German Patent No. DE 100 36 100 is the foreign counterpart to U.S. patent application Ser. No. 09/915,216, Publication No. 02-0017036, the disclosure of which is hereby incorporated herein by reference in its entirety.

Other types of shoes can be more easily ventilated, because of their specific use. U.S. Pat. No. 4,640,027, the disclosure of which is hereby incorporated herein by reference in its entirety, discloses a motor cycling boot wherein the passing airflow is guided into the interior of the shoe via an opening arranged in the boot shaft. U.S. Pat. No. 6,196,556, the disclosure of which is hereby incorporated herein by reference in its entirety, teaches a similar arrangement in an inline roller skate where airflow is directed through an opening at the front end of the shoe, thereby ventilating the foot via several holes in the sole of the skate. In both examples, the high relative velocity of the shoe during use aids in guiding the air into the interior of the shoe; however, these constructions transferred to ordinary shoes produce less than desirable results, and a considerably reduced ventilation effect is noted. This result clearly indicates that the arrangement of openings in the shoe alone generally is not sufficient for effective ventilation.

There is, therefore, a need for a shoe ventilation system that facilitates airflow within the shoe, even at the low relative velocities typical of walking or running.

SUMMARY OF THE INVENTION

The ventilation system of the present invention overcomes the disadvantages of other methods for transporting heat and humidity away from a wearer's foot. Generally, the system described herein assures a comfortable and healthy foot by providing proper ventilation and air exchange within the shoe, while at the same time preserving the mechanical stability required for sports shoes. Unlike a ventilation system comprising a number of simple holes in the exterior of the shoe, the present invention actively ventilates the shoe by directing the passing air into an opening via a guiding surface. In addition to the common passive ventilation caused by thermal convection, the arrangement of the guiding surface causes a flow effect due to the movement of the shoe through the air, which in turn increases convection and evaporation.

In one aspect, the invention relates to a ventilation system for an article of footwear. The ventilation system includes at least one opening in the upper of the shoe with at least one guiding surface extending over the opening. The guiding surface directs an airflow into the opening under a movement of the shoe through the air. As a result, fresh air is constantly supplied to the foot so that the air within the shoe does not become saturated with humidity.

In various embodiments of the foregoing aspect, the guiding surface extends substantially across an entire dimension of the opening. In certain embodiments, the longitudinal extent of the guiding surface is oriented substantially perpendicular with respect to an overall direction of the movement of the shoe relative to the ground or is inclined relative to a ground engaging surface of the shoe. If inclined, angles from approximately 0° to approximately 60° relative to the ground engaging surface are contemplated, with about 40° used in a particular embodiment. Alternatively, the guiding surface may be oriented substantially parallel to a passing airflow during the phase in a step cycle where the shoe moves at the greatest relative velocity.

In another embodiment of the above aspect, the outer edge of the guiding surface is inclined relative to a longitudinal axis of the shoe. Inclination angles from approximately 15° to approximately 90° are contemplated, with about 45° used in a particular embodiment. Such an orientation causes a funnel-like deviation of the passing airflow, directing the passing air into the opening of the ventilation system. Other embodiments increase ventilation of the shoe by employing a plurality of guiding surfaces extending over the opening. In such embodiments, ventilation is increased when the guiding surfaces are substantially identically shaped and/or disposed substantially parallel to one another. Generally, as the number of guiding surfaces increase, thereby increasing the size of the opening in the shoe, the stability of the shoe decreases. Therefore, some embodiments employ at least one beam interconnecting the plurality of guiding surfaces. Thus, a stable framework is created, which is capable of permanently resisting the substantial mechanical loads within the shoe.

In some embodiments of the above aspect, the opening is formed in a midfoot region of the upper, and/or is at least partially closed by a cover, which may be removable. In one embodiment, the cover may be movable along the opening to close off select areas of the opening. Also, the upper may include a membrane disposed across a portion of the opening. In various embodiments, the opening may be formed in a medial side of the upper, a lateral side, or both. Other embodiments of the above aspect include an outlet, which may be formed in a sole of the shoe. This outlet enables air to leave the surroundings of the foot, thus avoiding back pressure within the shoe and assuring a constant exchange of air.

In another aspect, the invention relates to a ventilation system for an article of footwear that includes an inlet, an outlet, and a ventilation channel in fluid communication with the inlet. The inlet and the outlet are formed in the article of footwear. In an embodiment of this aspect, the ventilation channel extends substantially along the medial side or lateral side of the shoe. In another embodiment, the ventilation channel may be in fluid communication with an interior region of the shoe. In certain embodiments of the above aspect, the inlet may be disposed proximate an instep region of the shoe upper and/or inclined relative to a longitudinal axis of the shoe. In the latter embodiment, inclination angles from approximately 15° to approximately 90° are contemplated.

In another embodiment of the above aspect, the ventilation system includes an outlet formed in the upper or the sole of the shoe, or both. In various embodiments, the outlet may be centrally disposed in the sole. In still other embodiments, a plurality of ventilation channels may be used, and they may be disposed substantially parallel to one another.

In still another aspect, the invention relates to a ventilation system for an article of footwear that includes at least one opening formed in the shoe upper and a linear vane structure including at least one vane disposed over the opening. In one embodiment of this aspect, the vane is substantially triangularly shaped. In another embodiment, the vane includes at least one guiding surface for directing an airflow into the opening under a movement of the shoe through the air. Another embodiment employs a plurality of vanes which are arranged substantially parallel to one another along the upper of the shoe.

These and other objects, along with advantages and features of the present invention herein disclosed, will become apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DESCRIPTION

Embodiments of the present invention are described below. It is, however, expressly noted that the present invention is not limited to these embodiments, but rather the intention is that modifications that are apparent to the person skilled in the art are also included. In particular, the present invention is not intended to be limited to sports shoes, but rather it is to be understood that the present invention can also be used to improve the foot climate of any article of footwear. Further, only a left or right shoe is depicted in any given figure; however, it is to be understood that the left and right shoes are typically mirror images of each other and the description applies to both left and right shoes.

Figure 1:
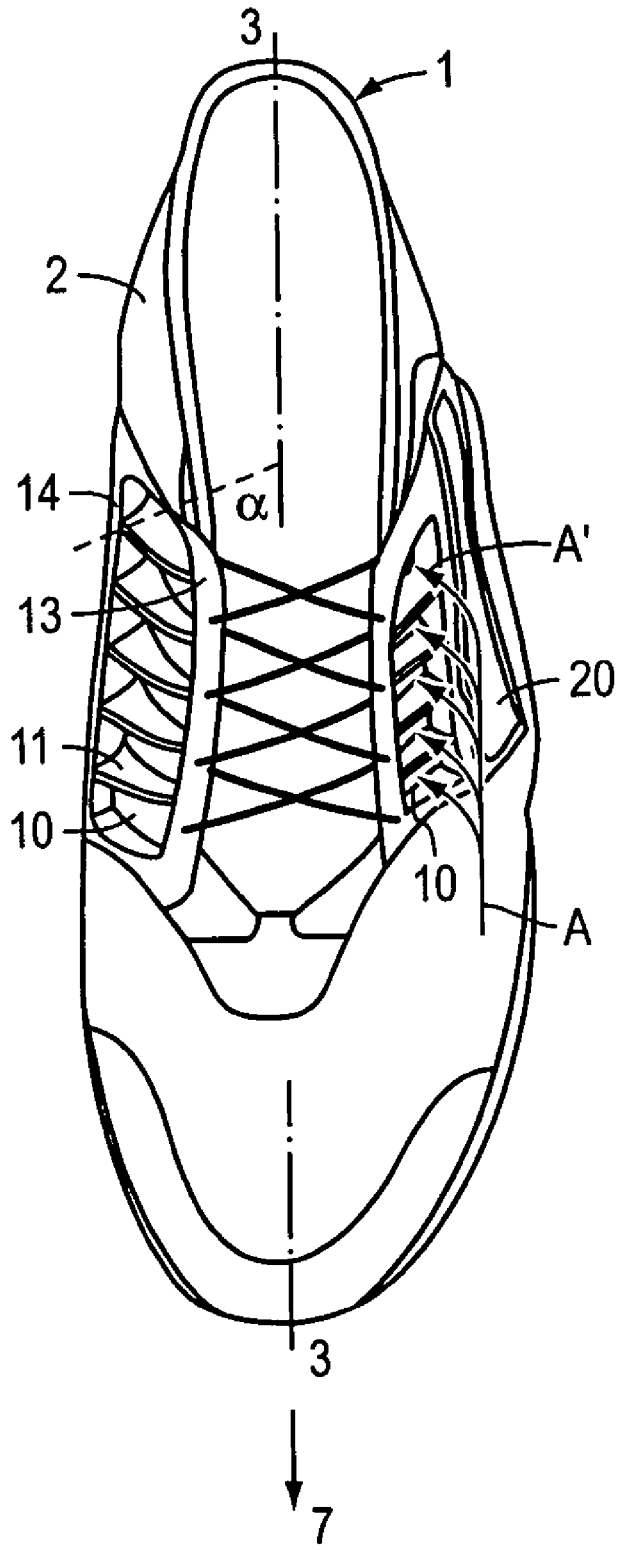
FIG. 1 is a schematic top view of a shoe incorporating one embodiment of a ventilation system in accordance with the invention.

FIG. 1 shows a top view of a shoe 1 incorporating one embodiment of the ventilation system of the present invention. As can be seen, an opening 10 is arranged on the medial as well as on the lateral side of the shoe upper 2, generally in the midfoot region of the shoe 1. The distribution of the opening 10 in the midfoot region allows ventilation of a large part of the foot surface without impairing the flexibility in the forefoot region or the stability in the heel region. A plurality of substantially parallel arranged vanes 11 bridge the opening 10. The angle $\alpha$ indicates the orientation of a guiding surface 12 (FIG. 2B) of the vane 11 relative to a longitudinal axis 3 of the shoe 1. The orientation of angle a is between approximately 15° and approximately 90° relative to the axis 3, preferably from about 30° to about 60°, and more preferably about 45°. Such a design guides air effectively into the interior of the shoe 1, even at low relative velocities of about 5–10 m/s (typical of running or walking, one direction of which is generally represented by arrow 7). In the embodiment shown, the vanes 11 are arranged within the opening 10. Alternatively, they can also be arranged above the opening 10.

In FIG. 1, the effect on airflow A is indicated on the lateral side of the shoe 1. As in the case of air around any moving body, the air surrounding the shoe 1 flows around the shoe 1 itself during walking or running. If no obstructions exist around the shoe 1, passing airflow A simply moves close to the surface of the shoe 1. The vanes 11 of the present invention, however, include leading edges 4 and guiding surfaces 12 that redirect the passing airflow A into the opening 10. This entering airflow A' is directed into the interior of the shoe 1, even if the shoe 1 is moving only at a low velocity. The extent of the ventilation effect obtained thereby is determined by the size and angular position of the vanes 11. For example, vanes 11 having a greater surface area divert greater amounts of the passing airflow A into the opening 10, but they simultaneously increase the width of the shoe 1. Moreover, vanes 11 that are substantially identically shaped can more effectively divert air into the opening 10. In addition, a streamlined covering element of the lacing could increase the effectiveness of the ventilation system.

Figure 2A:
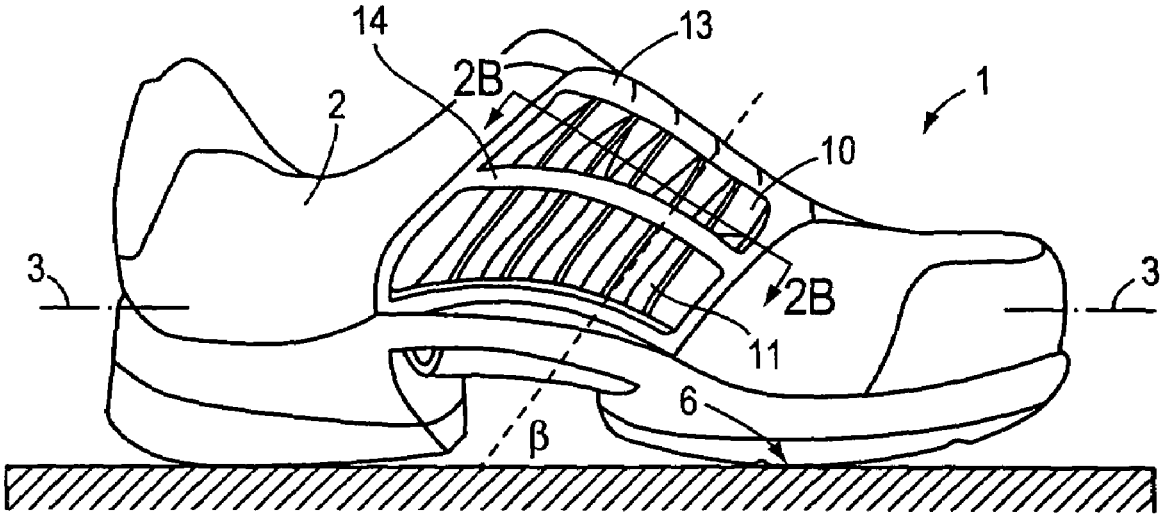
FIG. 2A is a schematic side view of the shoe shown in FIG. 1.

Turning now to FIG. 2A, which shows a medial side view of the shoe 1. The vanes 11 may be substantially vertically oriented, but in a particular embodiment they are inclined by an angle β with respect to a ground engaging surface 6 of the shoe 1. The orientation of angle β is approximately 0° to approximately 60° relative to the ground engaging surface 6 of the shoe 1, preferably from about 10° to about 50°, and more preferably about 40°. In one embodiment, angle β is substantially parallel to the direction of motion and to the passing air after push-off. Push-off occurs when the trailing foot is quickly brought forward during walking or running and is the phase of the greatest velocity relative to the surrounding air (see FIG. 3 for a view of the shoe 1 during this push-off phase). The specific orientation of the vanes 11 allows them to act as active guides for the air at both high and low relative velocities. The inclination angle a of the vanes 11 aids in guiding air during the low relative velocity phase of the step, and angle β reduces resistance to the air entering the opening 10 during the greatest relative velocity phase. FIG. 2A also shows an embodiment of the present invention where the opening 10, which is bridged by the vanes 11, is bordered by a frame 13. This frame 13 includes one or more transverse beams 14 for reinforcement, which interconnect the parallel vanes 11 to the frame 13 and thereby increase the stability of the arrangement.

Figure 2B:
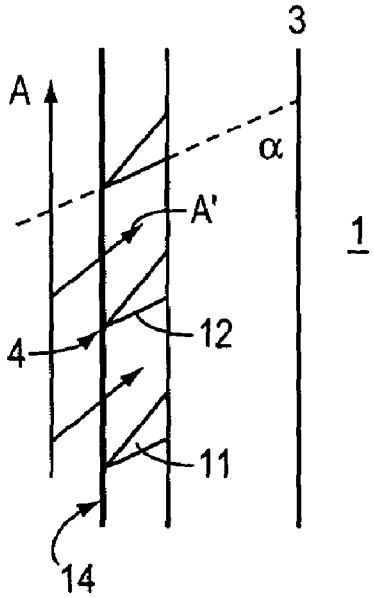
FIG. 2B is a schematic cross-sectional view of one embodiment of the vanes used in the embodiment of the ventilation system shown in FIG. 2A and taken at line 2B—2B.

Turning now to FIG. 2B, a cross-sectional view of one embodiment of the vanes 11 used in the ventilation system is shown. In this embodiment, the vanes 11 are substantially triangularly shaped and have a leading edge 4 and a pressure side air guiding surface 12 on the upstream side. The guiding surfaces 12 of the vanes 11 are held in a substantially parallel configuration by frame 13 and are further supported by beam 14, thereby forming a linear vane structure. As previously described, the guiding surfaces 12 are oriented at the angle α relative to the longitudinal axis 3 of shoe 1. This orientation causes the vanes 11 to actively redirect passing airflow A into the shoe 1. Such entering airflow A' acts to control moisture generated during sports activities.

Figure 2C:
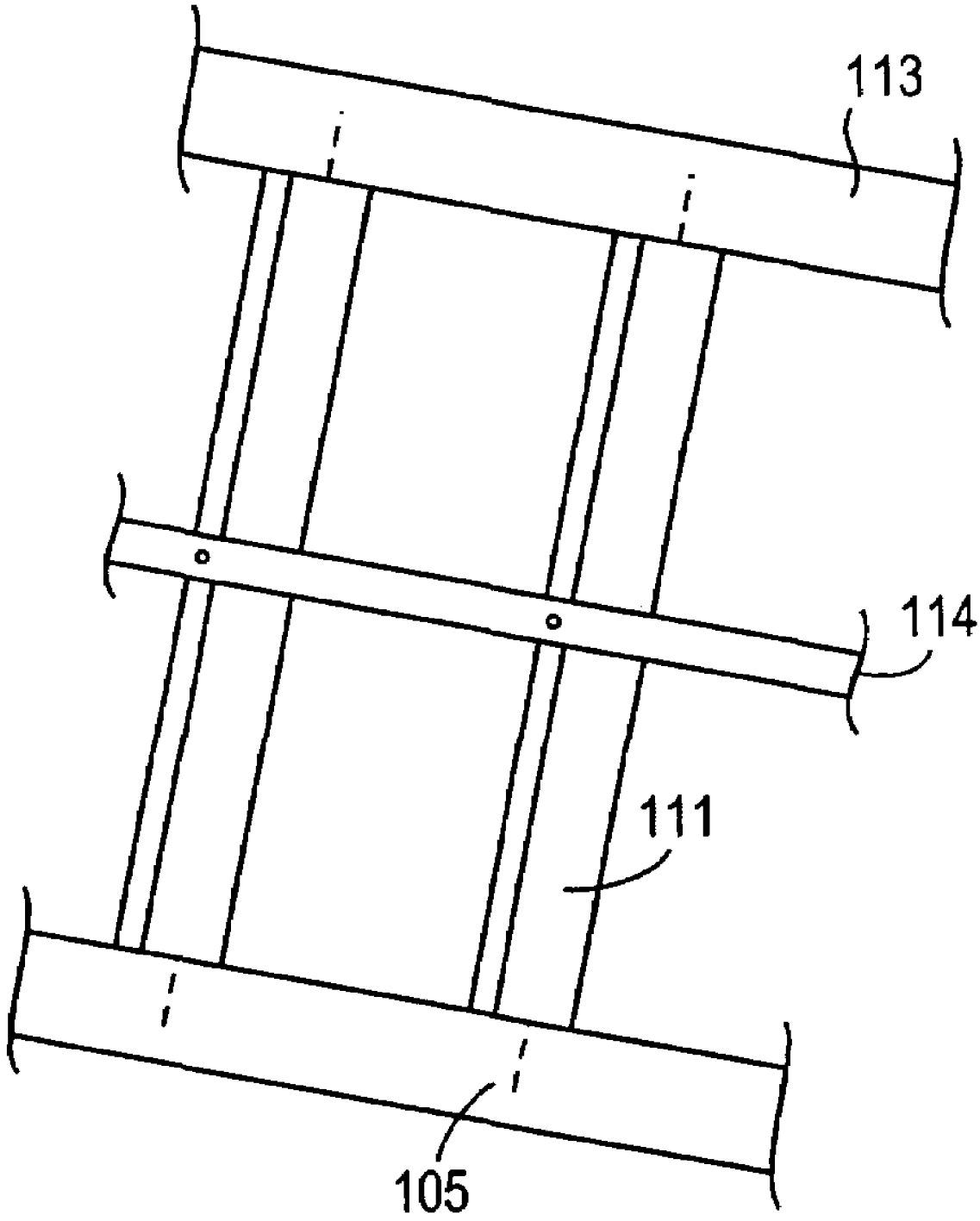
FIG. 2C is an enlarged schematic view of a portion of an alternative ventilation system in accordance with the invention.

It is also contemplated to rotatably suspend the vanes 11 in the frame 13 to modify the ventilation effect. For example, as shown in FIG. 2C, each vane 111 can be suspended by two small pins 105 or other supports on its upper and lower side in the frame 113. If the transverse beam 114 is mounted to the vanes 111 independently of the frame 113, a simple forward or backward movement of the beam 114 would simultaneously rotate all vanes 111, allowing a simple adjustment of the angle α, and therefore of the ventilation properties. It is contemplated that such an adjustment could completely close the ventilation system for use during cold or inclement weather.

Figure 3:
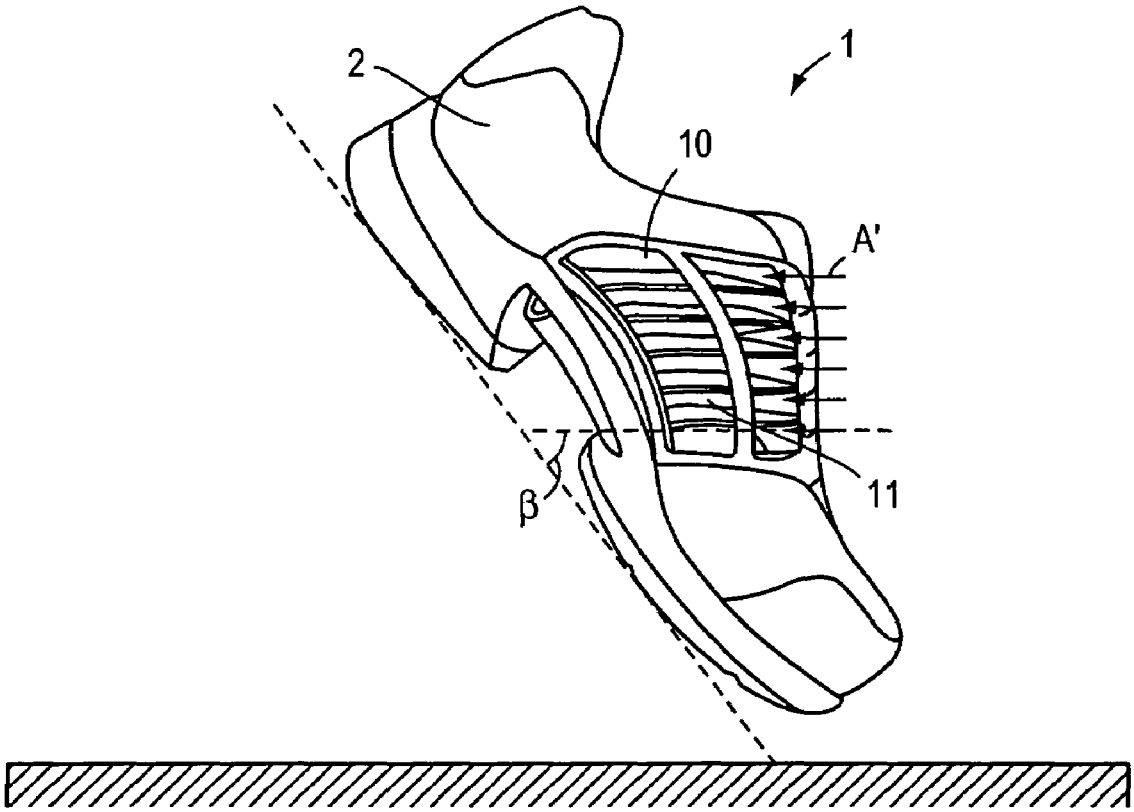
FIG. 3 is a schematic medial side view of the shoe shown in FIG. 1 during the phase of the greatest relative velocity of the shoe with respect to the surrounding air.

FIG. 3 shows the shoe at the point at or near push-off where the entering airflow A' is shown entering the opening 10 in a direction substantially parallel to the longitudinal axes of the vanes 11. As can be seen, airflow A' can easily enter opening 10 during this phase of greatest velocity, since the orientation of vanes 11 does not obstruct the airflow.

Figure 4:
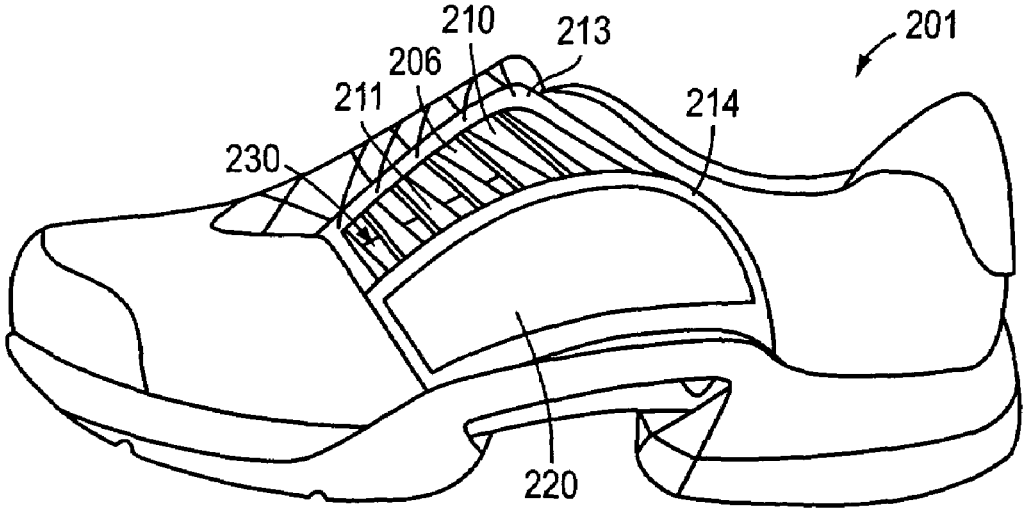
FIG. 4 is a schematic lateral side view of a shoe incorporating an alternative embodiment of a ventilation system in accordance with the invention, where the lower portion of the ventilation channels are covered.

FIG. 4 shows the lateral side of a shoe 201, including another embodiment of the ventilation system. As discussed with respect to FIG. 1, the system includes an opening 210, vanes 211, and a cross beam 214. As can be seen, the lower part of the frame 213 and the vanes 211 are closed by a cover 220. Use of the cover 220 over the vanes 211 forms a sequence of substantially parallel ventilation channels 230 extending generally vertically along the side of the shoe 201, directing air into the lower portion of the opening 210. The cover 220 may be made from a foil, a functional membrane, a breathable mesh material, or any combination thereof. The cover 220 may be releasably mounted to the shoe 201 by, for example, using a hook and loop type fastener, such as the VELCRO® brand sold by Velcro Industries B.V. As a result, the ventilation properties of the shoe 201 can be very easily modified. In addition, the cover 220 can be sized to completely cover the opening 210, and thus, completely seal the shoe 201 during the cold season or inclement weather. Although the cover 220 is shown only on the lateral side of the shoe 201, it is understood that the cover 220 may additionally or alternatively be arranged on the medial side of the shoe 201.

In any of the embodiments, if a relatively large opening 210 is provided, a breathable membrane 206 may be arranged either in front, within, or behind the frame 213, to avoid the unwanted penetration of exterior humidity into the interior of the shoe 201. Even a breathable membrane 206, however, will reduce the ventilation properties of the system, since it presents resistance for airflow to the foot. Thus, use of a membrane 206 is typically dependent on the intended use of the shoe 201.

Figure 5:
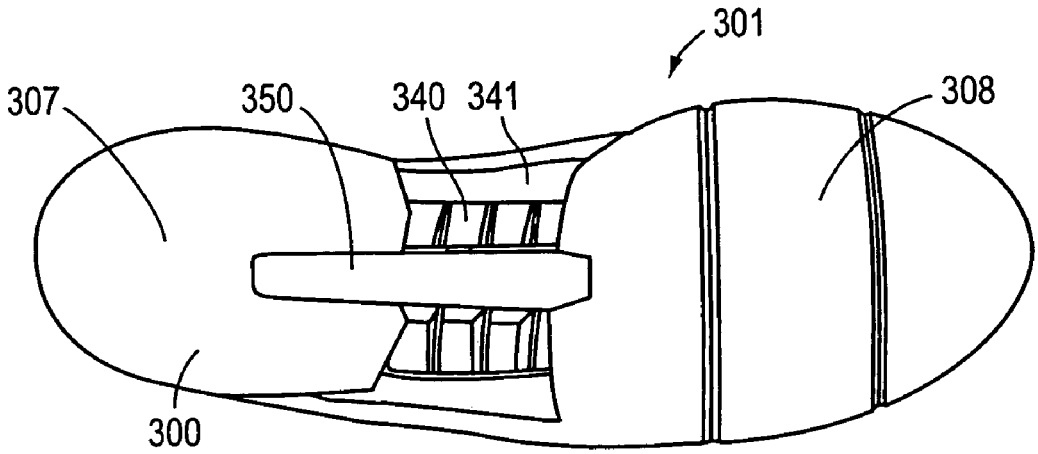
FIG. 5 is a schematic bottom view of a shoe incorporating an alternative embodiment of a ventilation system in accordance with the invention, where framed components are present in the sole of the shoe.

FIG. 5 shows a bottom view of an embodiment of a ventilation system in accordance with the invention having an outlet 340 in the sole 300 of the shoe 301. In this embodiment, ventilation is increased if the airflow is not only guided into the shoe 301 through one or more openings in the upper of the shoe 301, but also out of the shoe 301, through the outlet 340. This process facilitates the constant exchange of the air surrounding the foot so that moisture saturation is avoided. As can be seen, a series of vanes subdivide the opening in the sole 300 between the heel region 307 and forefoot region 308, thereby allowing the channeled air to emerge from the shoe 301. As a result, a continuous airflow is created within the shoe 301.

FIG. 5 also shows a torsion bar 350 between the heel region 307 and forefoot region 308 of the sole 300. The torsion bar 350 determines the torsional rigidity between the forefoot region 308 and the heel region 307 and, thereby controls a rotation of the two sole components with respect to each other. The single centrally disposed torsion bar 350 could be replaced or augmented with a pair of torsion bars on the medial and the lateral side edges of the sole 300. Frames 313 in the upper and frames 341 in the sole 300 manufactured of higher elasticity material would require a more rigid torsion bar 350 generally. Alternatively, other outlet openings may be arranged in different positions on the shoe, for example in the heel region 307, although this may decrease the stability of the sole 300. In such a case, the outlet 340 could primarily serve as inlet openings of the ventilation system. Generally, vanes of inlet openings are oriented against airflow, as in FIG. 2B, to scoop the passing air; whereas vanes of outlet openings are oriented with the airflow, to channel moisture laden air into the passing air.

Figure 6:
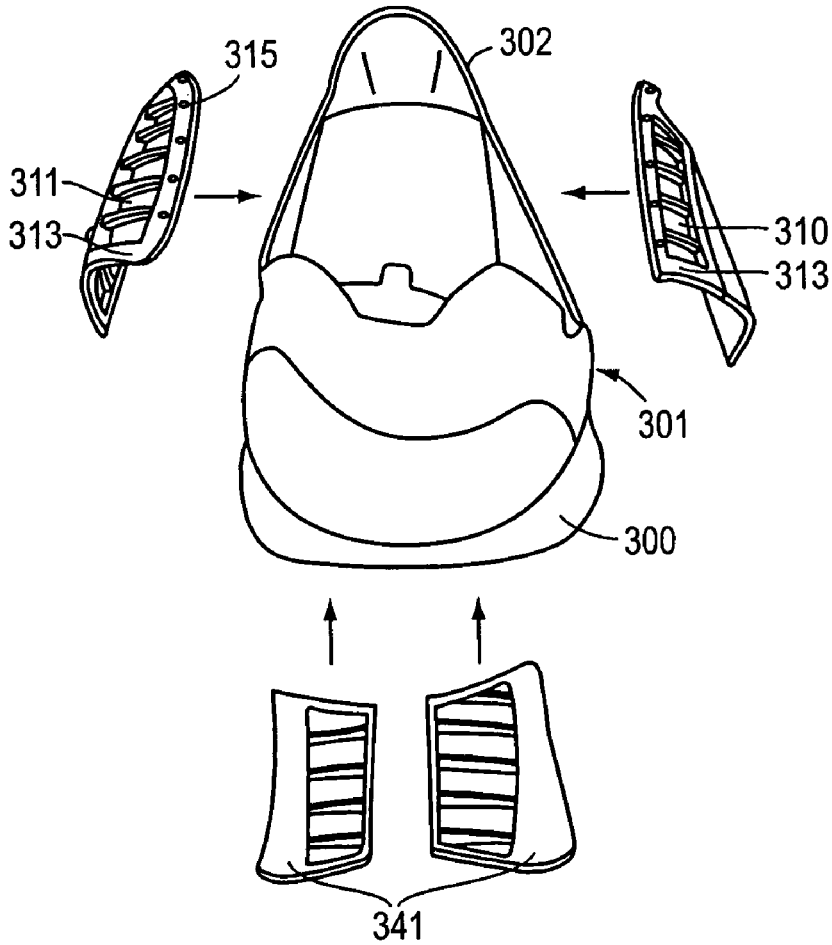
FIG. 6 is an exploded schematic view of a shoe illustrating the assembly of one embodiment of a ventilation system in accordance with the invention.

FIG. 6 shows an exploded view of the embodiment of the ventilation system of FIG. 5. Vanes 311 are produced together with the surrounding frame 313, for example by an integral manufacture using injection molding. Injection molding would allow additional shoe functions to be integrated into the frames 313, such as the integration of holes 315 for receiving laces or similar fastening systems. Other manufacturing techniques such as gluing or welding, however, are also contemplated for construction of the frames 313. Similarly, the openings 340 of the sole 300 of the shoe 301 are typically pre-manufactured as frames 341, which are subsequently integrated into the sole 300 of the shoe 301. Connection by gluing, welding or other suitable techniques for permanent interconnection of plastic materials could be implemented to attach both the frames 341 in the sole and frames 313 in the upper 302. In the case of the frames 341 in the sole 300, it is also possible to insert the finished components into a form and vulcanize the sole 300 around them.

In the described embodiment, the ventilation openings 310, 340 are exclusively arranged in the midfoot part of the shoe 301. In this embodiment, there are lower mechanical loads in this area of the sole 300 than in the heel region 307 and forefoot region 308. Sole frames 341 can be recessed, so that premature wear due to abrasion on the ground or the like is thereby avoided. Alternatively or additionally, it is also possible to arrange one or more of the described openings in the forefoot region 308 or the heel region 307 of the shoe 301.

Materials for the frames 313, 341 should be both sufficiently dimensionally stable and sufficiently flexible so that they can elastically react to the mechanical loads arising in the shoe 301 during use. Suitable materials include: polyurethanes, such as a thermoplastic polyurethane (TPU) or rigid polyurethanes (RPU); ethylene vinyl acetate (EVA); thermoplastic polyether block amides, such as the PEBAX® brand sold by Elf Atochem; thermoplastic polyester elastomers (TPE), such as the HYTREL® brand sold by DuPont; polyamides, such as nylon 12, which may include 10 to 30 percent or more glass fiber reinforcement; silicones; polyethylenes; and equivalent materials. Reinforcement, if used, may be by inclusion of glass or carbon graphite fibers or para-aramid fibers, such as the KEVLAR® brand sold by DuPont, or other similar method. Also, the polymeric materials may be used in combination with other materials, for example rubber. Other suitable materials will be apparent to those skilled in the art. The specific materials used will depend on the particular application for which the shoe is designed, but generally should be sufficiently compression-resistant, supportive, and flexible to the extent necessary for a particular sport.

Having described certain embodiments of the invention, it will be apparent to those of ordinary skill in the art that other embodiments incorporating the concepts disclosed herein may be used without departing from the spirit and scope of the invention. The described embodiments are to be considered in all respects as only illustrative and not restrictive.

What is claimed is:

1. A shoe including a ventilation system, comprising:

an upper defining at least one opening;

a substantially rigid frame extending along an edge of the opening; and at least one guiding surface bridging the opening and extending generally outward from a longitudinal axis of the shoe, wherein the guiding surface comprises:

a first end and a second end, the first end and second end integral with the frame; and a leading edge oriented generally forward of the guiding surface, relative to a heel of the shoe, wherein the guiding surface is adapted to redirect an airflow into the opening under a movement of the shoe.

2. The ventilation system according to claim 1, wherein the guiding surface extends substantially across an entire dimension of the opening.

3. The ventilation system according to claim 1, wherein a longitudinal extent of the guiding surface is oriented substantially perpendicular relative to a ground engaging surface of the shoe.

4. The ventilation system according to claim 1, wherein the guiding surface is inclined relative to a ground engaging surface of the shoe.

5. The ventilation system according to claim 4, wherein the guiding surface is oriented substantially horizontal during a greatest relative velocity phase of a step cycle.

6. The ventilation system according to claim 4, wherein the guiding surface is oriented at an angle from about 0° to about 60° relative to the ground engaging surface of the shoe.

7. The ventilation system according to claim 4, wherein the guiding surface is oriented at an angle of about 40° relative to the ground engaging surface of the shoe.

8. The ventilation system according to claim 1, wherein an outer edge of the guiding surface is inclined relative to a longitudinal axis of the shoe.

9. The ventilation system according to claim 8, wherein the outer edge of the guiding surface is oriented at an angle from about 15° to about 90° relative to the longitudinal axis of the shoe.

10. The ventilation system according to claim 8, wherein the outer edge of the guiding surface is oriented at an angle of about 45° relative to the longitudinal axis of the shoe.

11. The ventilation system according to claim 1, wherein a plurality of guiding surfaces bridge the opening.

12. The ventilation system according to claim 11, wherein the guiding surfaces are substantially identically shaped.

13. The ventilation system according to claim 11, wherein the guiding surfaces are disposed substantially parallel to one another.

14. The ventilation system according to claim 11, wherein the guiding surfaces are interconnected by at least one beam.

15. The ventilation system according to claim 1, wherein the opening is at least partially closed by a cover.

16. The ventilation system according to claim 15, wherein the cover is removable.

17. The ventilation system according to claim 1, wherein the upper further comprises a membrane disposed across at least a portion of the opening.

18. The ventilation system according to claim 1, wherein the opening is formed in a midfoot region of the upper.

19. The ventilation system according to claim 18, wherein the opening is formed in at least one of a medial side and a lateral side of the upper.

20. The ventilation system according to claim 1, wherein the shoe defines at least one outlet.

21. The ventilation system according to claim 20, wherein the outlet is formed in a sole of the shoe.

22. A shoe including a ventilation system, the ventilation system comprising:

an inlet formed in the shoe;

an outlet formed in the shoe; and at least two guide surfaces defining a ventilation channel therebetween in fluid communication with the inlet, wherein at least a portion of at least one of the at least two guiding surfaces comprises a leading edge, the leading edge oriented generally forward from the guiding surface relative to a heel of the shoe, wherein the guiding surface extends generally outward from a longitudinal axis of the shoe, and wherein the ventilation channel is adapted to direct an airflow into a lower portion of the inlet.

23. The ventilation system according to claim 22, wherein the ventilation channel extends substantially along at least one of a medial side and a lateral side of the shoe.

24. The ventilation system according to claim 22, wherein the ventilation channel is in fluid communication with an interior region of the shoe.

25. The ventilation system according to claim 22, wherein the inlet is disposed proximate an instep region of an upper of the shoe.

26. The ventilation system according to claim 22, wherein the inlet is inclined relative to a longitudinal axis of the shoe.

27. The ventilation system according to claim 26, wherein the inlet is oriented at an angle from about 15° to about 90° relative to a longitudinal axis of the shoe.

28. The ventilation system according to claim 22, wherein the outlet is formed in at least one of an upper and a sole region of the shoe.

29. The ventilation system according to claim 28, wherein the outlet is centrally disposed in a sole of the shoe.

30. The ventilation system according to claim 22, further comprising a plurality of ventilation channels.

31. The ventilation system according to claim 30, wherein the ventilation channels are disposed substantially parallel to one another.

32. A shoe comprising:

a longitudinal axis;

an upper defining at least one opening; and a ventilation system comprising a vane structure comprising:

at least one vane bridging the at least one opening, the vane comprising a guiding surface comprising a leading edge, wherein the leading edge is oriented generally forward of the guiding surface, relative to a heel area of the shoe, and wherein the guiding surface extends generally outward from the longitudinal axis so as to redirect an airflow into the at least one opening under a movement of the shoe.

33. The ventilation system according to claim 32, wherein the vane is substantially triangularly shaped.

34. The ventilation system according to claim 32, wherein the vane includes at least one guiding surface for directing an airflow into the opening under a movement of the shoe.

35. The ventilation system according to claim 32, wherein a plurality of vanes are arranged substantially parallel to one another along the upper of the shoe.

* * * * *